US008857114B2

(12) United States Patent
Lopez

(10) Patent No.: US 8,857,114 B2
(45) Date of Patent: Oct. 14, 2014

(54) STEP RE-TREAD SYSTEM AND APPARATUS

(76) Inventor: Michael Lopez, Point Pleasant, NJ (US)

( * ) Notice: Subject to any disclaimer, the term of this patent is extended or adjusted under 35 U.S.C. 154(b) by 0 days.

(21) Appl. No.: 13/226,480

(22) Filed: Sep. 6, 2011

(65) Prior Publication Data

US 2013/0055666 A1 Mar. 7, 2013

(51) Int. Cl.
*E04F 11/17* (2006.01)

(52) U.S. Cl.
CPC ..... *E04F 11/175* (2013.01)
USPC ..... 52/179; 52/188

(58) Field of Classification Search
USPC ..... 52/179, 188, 191; 312/235.1, 278
See application file for complete search history.

(56) References Cited

U.S. PATENT DOCUMENTS

| | | | | | |
|---|---|---|---|---|---|
| 1,343,739 | A * | 6/1920 | Nesdall | 52/191 |
| 2,842,813 | A * | 7/1958 | Van Fleet | 52/182 |
| 3,393,481 | A * | 7/1968 | Meuret | 52/188 |
| 3,909,997 | A * | 10/1975 | Eickhof | 52/188 |
| 4,004,384 | A * | 1/1977 | Hood | 52/188 |
| 4,455,797 | A * | 6/1984 | Naka | 52/179 |
| 5,493,823 | A * | 2/1996 | Baldi | 52/191 |
| 5,806,253 | A * | 9/1998 | Nelson | 52/179 |
| 6,115,975 | A * | 9/2000 | Abdollahi | 52/179 |
| 6,397,529 | B1 * | 6/2002 | Grenier | 52/182 |
| 7,464,505 | B2 * | 12/2008 | Grenier | 52/179 |
| 2008/0216421 | A1 * | 9/2008 | Chung et al. | 52/179 |
| 2008/0271390 | A1 * | 11/2008 | Lopez | 52/177 |
| 2011/0131902 | A1 * | 6/2011 | Young | 52/179 |
| 2011/0179729 | A1 * | 7/2011 | Thompson | 52/179 |

* cited by examiner

*Primary Examiner* — Adriana Figueroa
(74) *Attorney, Agent, or Firm* — Jon Fallon, Esq.; Michael P. Kochka, Esq.

(57) ABSTRACT

A system for refacing an existing set of stairs without having to remove the existing set in its entirety or cause destruction to the existing set of stairs and surrounding structure including a stringer refacing component, a stringer cap, a stair tread, a nosing, a cove molding, a riser cap, and a shoe moulding. The stair retread system may be placed over a set of stairs without removing or destroying the staircase as is common with typical staircase refinishing processes.

9 Claims, 4 Drawing Sheets

STEP RE-TREAD SYSTEM AND APPARATUS

CLAIM TO PRIORITY

This application claims priority to co-pending U.S. Design application Ser. No. 29/346,161, filed Oct. 28, 2009, which claims priority to U.S. patent application Ser. No. 12/113,313, filed May 1, 2008, which claims priority to U.S. Provisional Patent Appl. No. 60/927,047, filed May 1, 2007, all of which is incorporated by reference herein.

BACKGROUND OF THE DISCLOSURE

1. Field of the Invention

The invention relates to an apparatus for renovating a stair step or set of stairs and more specifically, an apparatus for refacing a stair step or set of stairs without requiring the removal of the entire stair step or set of stairs.

2. Description of the Prior Art

To replace or renovate a stair step or set of stairs, such as in a residence, it is often required to remove a large portion of the step and involve a large amount of labor and destruction to the stair step or set of stairs in its entirety, and to any structure surrounding the stairs. The typical process involves sanding, planing, patching, and replacing the stairs, thereby creating a large mess and disruption to any existing components of the home, such as, for example, destruction to any trim along the stairway, paneling, drywall, or flooring adjacent to the stairway. This process can also be costly and time-consuming.

Thus, there is a need to be able to replace or renovate steps or stairs without involving the problems of the above.

SUMMARY OF THE INVENTION

Accordingly, an embodiment of the present invention depicts an tread-cap apparatus for refacing an existing stair step, wherein the tread-cap apparatus includes a stair tread, a nosing, a cove moulding, a riser cap, and a shoe moulding. The tread-cap apparatus may be placed over an existing stair step, thereby overcoming the need to remove or destroy the existing stair step as is common with typical stair refinishing processes.

Another embodiment of the present invention includes a tread-cap apparatus further comprising a first substrate layer for strength, such as a cross-grained veneer layer, placed between the stair tread and the existing stair step. Another aspect of this embodiment includes a second substrate layer, such as a layer of formica, to improve the adhesion of the tread-cap apparatus to the existing stair step.

Another embodiment of the present invention depicts a step re-tread system that can resurface additional aspects of a staircase, including common components such as stringers, risers, treads, cove, and shoe. The step re-tread system comprises the tread-cap apparatus described above and further comprises a stringer refacing component and a fitted stringer cap. The inventive system allows you to reface a plurality of steps or an entire stair case without requiring removal of any components of the step or staircase with the exception of the nosing.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1A:
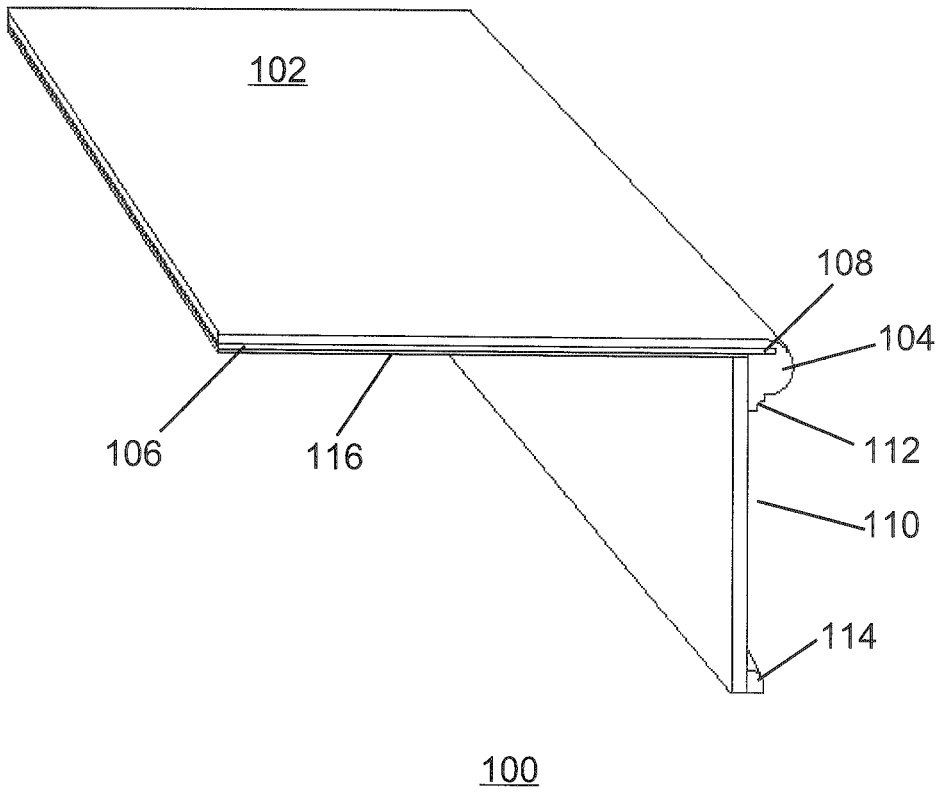
FIG. 1A provides a perspective view of a tread-cap apparatus, in accordance with an embodiment of the present invention.
Figure 1B:
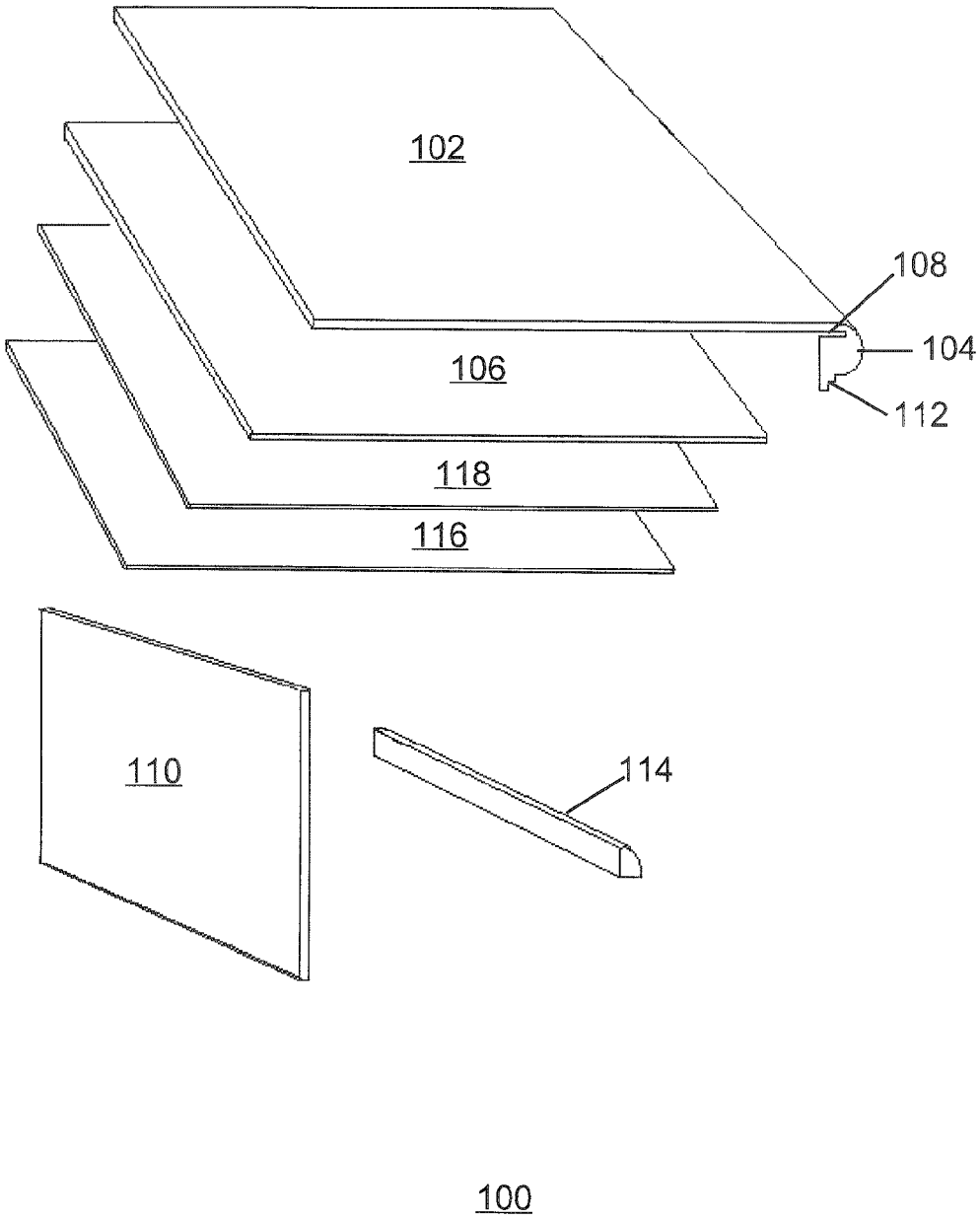
FIG. 1B provides an exploded view of the tread-cap apparatus shown in FIG. 1A, in accordance with an embodiment of the present invention.

An embodiment of the present invention includes a tread-cap apparatus 100 for refacing an existing stair step, as shown in perspective and exploded views in FIGS. 1A and 1B, respectively. The tread-cap apparatus 100 comprises a stair tread 102, a nosing 104, a riser cap 110, a cove moulding 112, and a shoe moulding 114. In FIG. 1A, the nosing 104 is connects to an edge portion of the stair tread 102 and is placed adjacent to a top portion of the riser cap 110. The cove moulding 112 connects to a bottom portion of the nosing 104. Finally, the shoe moulding 114 is placed near a bottom portion of the riser cap 110.

To apply the tread-cap apparatus 100, an existing nosing of the existing stair step is removed along with any cove and shoe mouldings that may exist. Removal of the existing cove and shoe mouldings provide for the riser cap 106 to be flush against an existing step riser of the stair step when applied. The tread-cap apparatus 100 is then fitted onto the existing stair step with the stair tread 102 covering an existing step tread, the riser cap 110 covering the existing step riser, and the nosing 104, the cove moulding 112, and the shoe moulding 114 then being placed accordingly.

An aspect of this embodiment includes a first substrate layer 106 to provide additional strength and stress absorption to the tread-cap apparatus 100. The first substrate layer 106 further can be used to reduce any stress to the nosing 104 and prevent the nosing 104 from breaking off. To prevent the nosing 104 from breaking, a slot joint 108 is cut into a portion of the nosing 104, beginning from a back portion of the nosing and extending partially towards a front portion of the nosing. An edge portion of the first substrate layer 106 then is inserted into the slot joint 108.

The tread-cap apparatus 100 can be applied to an existing stair step using a layer of adhesive 116, such as a polyethylene or polyurethane based adhesive. The adhesive layer 116 is placed onto the existing step tread and step riser, and the tread-cap apparatus 100 is placed onto the adhesive layer 116.

In another embodiment of the present invention, as shown in FIG. 1B, a second substrate layer 118 is added to the tread-cap apparatus 100 to improve the adhesion of the tread-cap apparatus 100 to the existing stair step. For example, a layer of formica may be used to provide improved adhesion between the tread-cap apparatus 100 and the existing stair step, as well as improved strength and stress-reduction.

The tread-cap apparatus 100, that is, the stair tread 102, the nosing 104, the riser cap 110, the cove moulding 112 and the shoe moulding 113, can be manufactured as individual and separate components to be connected during application. Alternately, these components may be manufactured as a single unit cut from a single piece of material. The tread-cap apparatus 100 can be made of wood, of composite materials, or a combination of wood with composite materials. Further, the tread-cap apparatus 100 can be pre-finished with any color, paint or stain to match construction surrounding the stair step or as preferred by an owner.

The components of the tread-cap apparatus 100 may be customized to any dimensions desired. For example, an embodiment of the present invention includes a tread cap-apparatus dimensionally sized to include a stair tread having a thickness of three thirty-seconds of an inch, a veneer substrate layer having a thickness of one-eighths of an inch, a formica substrate layer having a thickness of one thirty-seconds of an inch, and an adhesive layer having a thickness of one thirty-seconds of an inch. The nosing can be dimensionally sized to have a height of one and one-fourths inches as measured from a top surface of the nosing (wherein this top surface is flush with a top surface of the stair tread when the nosing is placed adjacent to the stair tread) to a bottom surface of the nosing. The riser cap can be dimensionally sized to have a thickness of one-quarter of an inch. The cove moulding and the shoe moulding can both be dimensionally sized to have a thickness of one-half of an inch. The tread-cap apparatus with the components sized having the above dimensions provides a preferred embodiment for refacing a stair step. An alternate embodiment of the present invention includes a tread-cap apparatus with a stair tread manufactured into multiple pieces to simplify the application of the apparatus to an existing stair step.

In another embodiment of the present invention, one or more substrate layers can be layered beneath the stair tread 102 with different thicknesses in different locations of each layer in order to accommodate multiple thicknesses in an existing stairway, such as, a tongue and groove flooring stairway system, illustratively.

Figure 2:
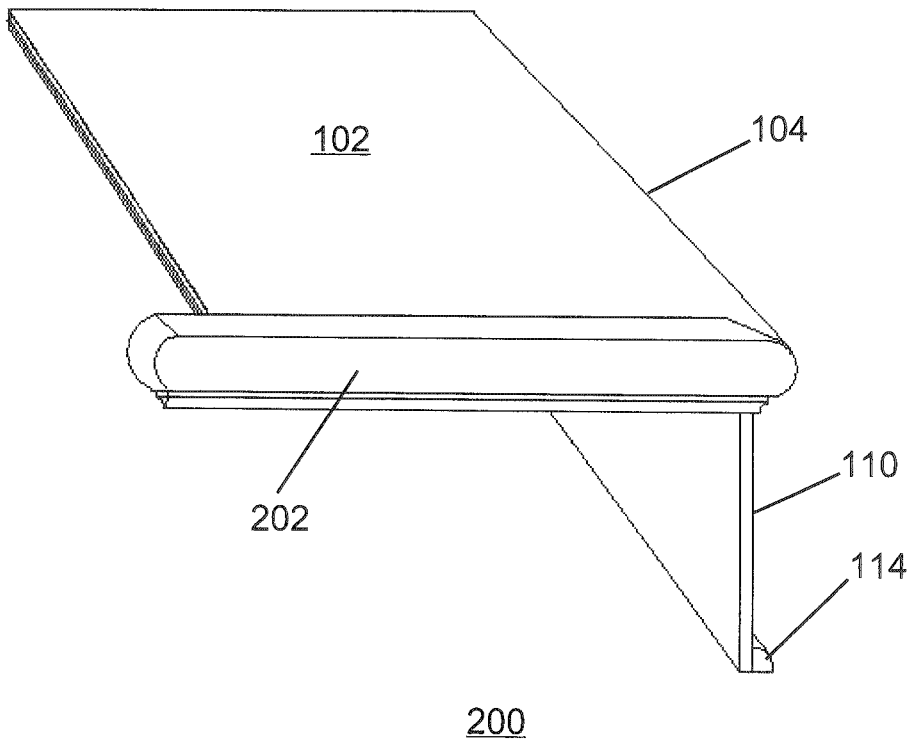
FIG. 2 provides a perspective view of the tread-cap apparatus shown in FIG. 1A with a modification, in accordance with an embodiment of the present invention.

FIG. 2 shows a modification made to the tread-cap apparatus 100 as described in FIGS. 1A and 1B. In FIG. 2, a side cap 202 is attached adjacent to a side portion of the stair tread 102 and a side portion of the nosing 104. The side cap 202 is used as a decorative trim when a side of the stair step does not abut against a stairwell wall.

A step re-tread system for resurfacing a staircase, including common components such as stringers, risers, treads, cove, and shoe combines the tread-cap apparatus previously described in FIGS. 1, 1A, and 2 with a stringer refacing component and a fitted stringer cap. The inventive system allows you to reface a plurality of steps and/or an entire stair case without requiring removal of any components of the step or staircase with the exception of the nosing.

Figure 3:
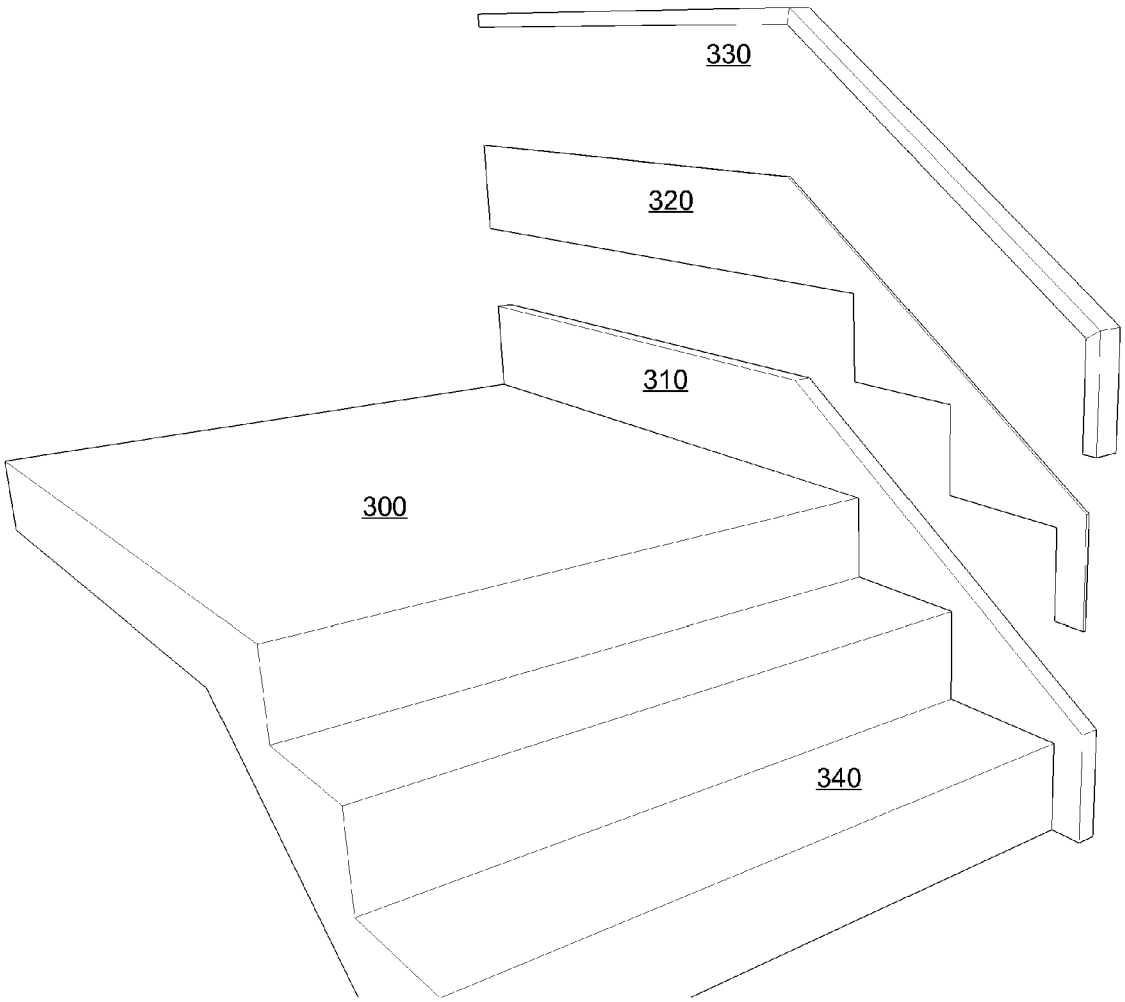
FIG. 3 illustrates a system for refacing a set of stairs, in accordance with an embodiment of the present invention.

In application, looking to FIG. 3 and a set of stairs 300, once the nosing is removed, stringers 310 of the set of stairs 300 are refaced on all exposed sides by covering them with a stringer refacing component 320, such as, for example, a veneer that is specially cut and designed to fit over the existing stringers 310. Following the stringer refacing, a stringer cap 330 is installed over the stringer 310 and/or the refacing component 320.

An example of how such an inventive step re-tread system can be applied and fit to common construction codes is provided below:

(1) Tread nose projection past vertical riser below (¾ inch min. to 1½ inch max.) required on stairs with solid risers (exceptions are below).

(2) Tread nose projection uniformity (<=⅜ inch variation).

(3) Tread nose curve radius (=<9/16 inch).

(4) Tread Nose not required if tread depth is =>11 inch.

(5) Tread Nose not required on open stair treads (open riser).

The radius of curvature at the leading edge of the tread shall be not greater than 0.5 inch (12.7 mm). Beveling of nosing's shall not exceed 0.5 inch (12.7 mm). Risers shall be solid and vertical or sloped from the underside of the leading edge of the tread above at an angle not more than 30 degrees (0.52 rad) from the vertical. The leading edge (nosings) of treads shall project not more than 1.25 inches (32 mm) beyond the tread below and all projections of the leading edges shall be of uniform size, including the leading edge of the floor at the top of a flight.

The radius of curvature at the leading edge of the [stair] tread shall be no greater than 9/16 inch (14.3 mm). A nosing not less than ¾ inch (19 mm) but not more than 1¼ inch (32 mm) shall be provided on stairways with solid risers.

The greatest [stair tread] nosing projection shall not exceed the smallest nosing projection by more than ⅜ inch (9.5 mm) between two stories, including the nosing at the level of floors and landings.

Beveling of [stair tread] nosing shall not exceed ½ inch (12.7 mm). Risers shall be vertical or sloped from the underside of the leading edge of the tread above at an angle not more than 30 (0.51 rad) degrees from the vertical.

Although various embodiments which incorporate the teachings of the present invention have been shown and described in detail herein, those skilled in the art can readily devise many other varied embodiments that still incorporate these teachings.

I claim:

1. A system for use in renovating an existing set of stairs, the system comprising:

an integrally formed stair tread and nosing assembly, the stair tread comprising a plurality of layers, each layer comprising a substantially uniform thickness along its length, wherein at least one layer of the plurality of layers of the stair tread is embedded into a slot in a back portion of the nosing;

a riser cap, wherein an uppermost horizontal surface of the riser cap is flush with a bottom surface of the slot; and wherein the integrally formed stair tread and nosing assembly is devoid of mechanical fasteners.

2. The system of claim 1, further comprising:

a cove moulding; and a shoe moulding.

3. The system of claim 1, wherein the nosing comprises a cove moulding affixed to a front portion thereof.

4. The system of claim 1, wherein the at least one layer of the stair tread is affixed into the slot in the back portion of the nosing using an adhesive.

5. The system of claim 1, further comprising a side cap.

6. The system of claim 1, further comprising a stringer refacing component and a stringer cap.

7. A system for use in renovating an existing set of stairs, the system comprising:

an integrally formed stair tread and nosing assembly, the stair tread comprising a plurality of layers, each layer comprising a substantially uniform thickness along its length, the nosing having a cove moulding affixed to a front portion thereof, and wherein at least one layer of the plurality of layers of the stair tread is embedded and affixed into a single slot in a back portion of the nosing using an adhesive, creating a single unitary structure;

a riser cap, wherein an uppermost horizontal surface of the riser cap is flush with a bottom surface of the slot;

wherein the integrally formed stair tread and nosing assembly is devoid of mechanical fasteners.

8. The system of claim 7, further comprising a shoe moulding.

9. The system of claim 7, further comprising at least one of a side cap, a stringer refacing component and a stringer cap.

* * * * *